US006837745B2

(12) United States Patent
Takada et al.

(10) Patent No.: US 6,837,745 B2
(45) Date of Patent: Jan. 4, 2005

(54) ELECTRIC JACK

(75) Inventors: Syoichi Takada, Kanagawa (JP); Satoru Kihira, Kanagawa (JP); Kiyoshi Washino, Kanagawa (JP); Tsuyoshi Fukami, Kanagawa (JP); Masato Kato, Kanagawa (JP)

(73) Assignee: J.S.T. Mfg. Co., LTD, Osaka (JP)

( * ) Notice: Subject to any disclaimer, the term of this patent is extended or adjusted under 35 U.S.C. 154(b) by 0 days.

(21) Appl. No.: 10/428,034

(22) Filed: May 2, 2003

(65) Prior Publication Data

US 2003/0232543 A1 Dec. 18, 2003

(30) Foreign Application Priority Data

May 7, 2002 (JP) ..... 2002-131631

(51) Int. Cl.[7] ..... H01R 13/40

(52) U.S. Cl. ..... 439/595; 439/521; 439/694; 439/902; 439/881

(58) Field of Search ..... 439/595, 521, 439/901, 902, 694, 881

(56) References Cited

U.S. PATENT DOCUMENTS

| | | | | | |
|---|---|---|---|---|---|
| 5,071,369 | A | * | 12/1991 | Denlinger et al. | 439/595 |
| 5,100,345 | A | * | 3/1992 | Endo et al. | 439/595 |
| 5,199,902 | A | * | 4/1993 | Kahle et al. | 439/595 |
| 5,746,618 | A | | 5/1998 | Gauker | |
| 6,247,966 | B1 | * | 6/2001 | Klein et al. | 439/595 |
| 6,419,522 | B1 | * | 7/2002 | Bonilla | 439/595 |
| 6,425,780 | B1 | * | 7/2002 | Muhlmichel | 439/460 |
| 2002/0048975 | A1 | | 4/2002 | Horikoshi | |

FOREIGN PATENT DOCUMENTS

| | | | |
|---|---|---|---|
| JP | 64-12386 | U | 12/1989 |
| JP | 11-191457 | A1 | 7/1999 |
| JP | 2001-203043 | A1 | 7/2001 |
| JP | 2001-217049 | A1 | 8/2001 |
| JP | 2002-164126 | A1 | 6/2002 |
| JP | 2002-164130 | A1 | 6/2002 |
| JP | 2002-164133 | A1 | 6/2002 |
| WO | WO-98/07213 | A2 | 2/1998 |

OTHER PUBLICATIONS

European Search Report deated Jun. 25, 2004.

* cited by examiner

*Primary Examiner*—Tho D. Ta
(74) *Attorney, Agent, or Firm*—Rader, Fishman & Grauer PLLC

(57) ABSTRACT

A jack, which would cause hardly a defective connection even if a mechanical deformation is received when attaching or using it, will be offered. The electric junction of contacts (3), (4) and leads (51), (52) is done by crimping, the crimping portions **(3*c*), (4*b*) are arranged in a housing (1) of the jack which is not exposed easily to a mechanical deformation, and, in addition, the structure is so made that the mechanical force doesn't work easily on the crimping portions (3*c*), (4*b*) also by the leads (51), (52)** extending from the jack.

11 Claims, 9 Drawing Sheets

ELECTRIC JACK

CROSS-REFERENCE TO RELATED APPLICATIONS

This application is based upon and claims the benefit of priority from the prior Japanese Patent Application No. 2002-131631, filed May 7, 2002, the entire contents of which are incorporated herein by reference. This application is related to co-pending United States patent application entitled "Connector Structure" filed on even date herewith. That co-pending application is also expressly incorporated herein by reference.

BACKGROUND OF THE INVENTION

1. Field of the Invention

The present invention relates to a jack which transmits the electric signal or energy and is used for a portable electronic device such as notebook computers and, more particularly, it relates to a structure of a housing, a contact, etc. being used for the jack.

2. Background Art

Many portable electronic devices are operated with the direct current, and the voltage of domestic alternating current power is stepped down by an AC adaptor and at the same time converted into the direct current, and served as the power supply for the portable electronic device. Most AC adaptors use the cable provided with a plug to be inserted into the power supply jack of the portable electronic device so as to supply the power. As an example of such power supply jacks, Examined Japanese Utility Model No. 1989-12386 discloses a power supply jack, which is soldered directly to the circuit board.

However, in the DC jack disclosed in the Japanese Utility Model No. 1989-12386, a crack may be generated in a soldering part to which a lead is fixed by plugging a plug into or unplugging the plug out of the jack with force when the plug engages or disengages with the jack, resulting in a defective conduction.

SUMMARY OF THE INVENTION

The present invention aims to provide a connection structure of the power supply jack to prevent such defective connection between the power supply jack and the power supply circuit. The connection structure of power supply jack provided herein is not limited to a jack which provides the power supply, but it may also apply any kinds of jacks, which may transmit an electric signal and electric energy. Therefore, the purpose of the present invention is to provide a variety of jack connection structures for any use.

In analyzing a conventional jack structure, it is understood that the soldering portion under a mechanical stress may cause the crack. Then, according to the present invention, a jack contact and a lead are connected by crimping the lead at a crimping portion of the jack contact, and the crimping portion is disposed inside a housing of the jack so that it may avoid excess mechanical stress applied via the lead or directly by an operator.

Further, in order to improve the productivity, an opening for inserting the contact is disposed on a back side of the jack so that the contact may be easily put into the housing. The opening and an engaging and/or stopping structure such as lance, etc. for fixing the contact inside the housing so that the contact may perform its function may be closed or covered with the cover such that readjustment of the components inside the housing is not necessarily needed.

More concretely, the present invention provides the following.

(1) A jack having an insulating housing and an electroconducting contact installed in the housing, the jack comprising: a cover for covering at least a part of the housing; wherein the contact comprises: an exposed portion which can be viewed from outside of the housing; a crimping portion for crimping a lead being connected to a power supply circuit of a device, to which the jack is fixed; and; a contact engaging portion for stopping the housing; wherein the housing comprises: a contact insertion opening which is to be covered with the cover; a lead extending part where the lead crimped by the crimping portion extends, and a housing engaging portion for engaging with the contact engaging portion; and; wherein the contact engaging portion and the housing engaging portion engage with each other so that the contact is fixed to the housing at a predetermined position of the housing.

The device being provided with the above-mentioned jack may include a device that uses the jack as power supply jack and, for instance, portable electric appliances including the personal computer of the notebook type, etc., can be cited. The lead connected to the power supply circuit may include a lead wire being connected to the power supply circuit of the electric device, for instance, to transfer electric power for the power supply. In general, the lead may be a line where an electroconductive core member is covered with an insulation cladding material. There may be one or more leads. Connecting the lead by crimping generally may be to connect the lead, which is crimped at a crimping portion where a part of a terminal member is bent in a manner to wrap a core member such as a conductive wire so that the lead may be connected electrically (and often mechanically) to the terminal member. Further, it may include the mechanical fixation of the lead at the crimping portion by bending a part of the terminal member in a manner to wrap the lead over the insulating material thereof. Covering a part of the housing with the cover may include that the covered part may not be seen from outside and that it may not be brought into an electrical or physical contact with something outside. Especially, when an opening or a concaved portion is disposed on or in the housing, the opening or the concaved portion may be closed or a vacancy be made in the housing by covering with the cover. The vacancy might become a room (including a chamber) for storage in the housing. The lead extending part where the lead is extending may include a passage where the lead physically passes. For instance, if the housing includes a concave portion, a hole, recess and so on may serve as the lead extending part. Further, when the lead is buried in the housing member for instance, the space where the lead passes may be included by the lead extending part. Further, the lead extending part may communicate with an opening on the housing such that the lead may extending outside the housing through the opening.

The predetermined position in the housing where the contact is fixed may be a position of the housing in which at least a part of the contact is inserted. Although the contact has a limited degree of freedom by the housing, "being fixed" may include being in a fixed state under a preload so as to have no play and also being a state with play or backlash. The stopping means between the contact and the housing may include any members for the same function. It may include a projection part, convex portion, uplift part or other members. It may also include a portion protruding from the member surface when a nail, bolt, rivet or the like is pegged. It may also include other protrusions such as a hook, burr, return, and so on. A protruding portion and a portion for receiving the protruding portion such as flat part, concave portion, loop or the may also be included. It may include a mechanical, electrical, mechatronical engaging mechanism such as a lance. That the contact is fixed to the housing by engaging such stopping stopping means may include that the contact remains at the predetermined position of the housing and does not fall off the position.

(2) The jack according to (1), wherein the housing is provided with a lead extending opening having shape and size corresponding to shape and size of the lead extending part. The lead extending opening may be an opening disposed in the housing. It may be disposed toward a lead extension direction of the lead extending part. The lead may be extended from the opening to the outside of the housing and connected to an external destination of connection (for instance, power supply circuit, terminal and so on.)

(3) The jack according to (2), wherein the contact is to be inserted through the contact insertion opening into the housing, and wherein the contact insertion opening communicates with the lead extending opening. The contact insertion opening may be an opening for inserting the contact from the outside of the housing, in order to fix the contact at a predetermined position in the housing. Therefore, the size of the contact insertion opening may be large enough for contact to be inserted therethrough, and, it may also be an opening that is open only when the contact is inserted. For instance, it may include an opening with a door or split doors mechanically hinged with a spring such that they open by pushing. The shape of the opening may vary, provided that the opening allows to insert the contact. That the opening is disposed such that at least a part of the opening may be to be covered with the cover and the part of the opening may be closed or blockaded by the cover. For instance, the fixation of the contact at the predetermined position of the housing when the contact is inserted through the aforementioned contact insertion opening may include that the contact remains at the predetermined position of the housing, and that it does not fall off therefrom, and that it can move front-to-back, right-to-left to a certain degree around the predetermined position of the housing.

(4) The jack according to (2) or (3), wherein the contact insertion opening is to be closed by sliding the cover in a lead extending direction over the lead extending opening. Here, closing the contact insertion opening by sliding the cover in the lead extension direction may mean that the cover or a backing thereof has a slide mechanism with a degree of freedom of sliding in the lead extension direction. The inside can be checked again or repaired even after it is once closed, if such closing mechanism to close or open it reversibly. Further, with such mechanism, the cover may not be opened easily even if the jack is moved by the connected lead, which is pinched by a hand. The structure may be made hard to open once it is closed, by installing a lock mechanism on the sliding cover.

(5) A jack being connected to an electric energy supply or demand part through a lead, comprising: a contact for contacting an outside terminal to be connected to the jack, the contact having a crimping portion for crimping the lead to be connected to the contact, a housing having a contact insertion opening through which the contact is to be inserted and a contact insertion room in which the contact is to be disposed and; a cover for closing the contact insertion opening when the contact is disposed in the contact insertion room; wherein the housing comprises: a crimping portion storage passage for storing the crimping portion and a lead extending part for extending a lead from the crimping portion storage passage to outside of the housing.

Here, the electric energy supply part may include a power supply circuit, for instance, and, a circuit or the like for supplying the electrical signal. Such energy supply part may supply the electric energy or the like transmitted by the jack to the circuit and so on, and may supply electric energy or the like to the jack oppositely. The demand part of electric energy may be a circuit or the like that consumes electric energy, and it may be a connection destination of the lead where the electric energy is transmitted, while the electric energy is supplied to the jack by way of an outside terminal such as plug or the like inserted into the jack. The contact that is brought into contact with the outside terminal may include a contact, which may include a transmitting member, a transmitting part and any other elements that transmit what to be transmitted by contacting (for instance, electric energy). Crimping may include a connecting method of transmitting (for instance, electric energy) what to be transmitted by maintaining the contact pressure between the lead and an electroconductive member or the like by utilizing the elasticity of the electroconductive member or the like, after the lead to be connected is tightly wrapped with the electroconductive member such as a metallic board or an electric part or others. Such part, place, or point where such crimping is made may be referred to a crimping portion, and the contact includes the crimping portion. The contact insertion opening is an opening to insert the contact into the housing therethrough, and has the aforementioned feature. Further, the contact insertion room is a space including the place where the contact is maintained or is stored, and may include what is formed inside the housing. A part of the contact may be disposed in the contact insertion room by inserting, retaining, storing or else. As a result, the contact can be fixed to the housing. However, such fixation may include a fixation that doesn't allow the contact to move at all and that can allow the contact to move somewhat with some degrees of freedom, in a similar manner mentioned before. The contact insertion opening may be closed with the cover while the contact is disposed in the insertion room. That is, the contact insertion opening can enter a state where there is no substantial obstacle against the cover which may slide to cover the opening with the contact disposed inside the insertion room. The cover may be a board or a plate with a rectangular, circular, or any arbitrary shape in the plan view, and may have any three-dimensional arbitrary shapes such as a lid, a hat, a bascket with mesh. The material for the cover may not be limited to organic, inorganic, metallic or any other materials, as long as the cover maintains the function. However, an insulating material is more preferable.

(6) The jack according to (5), wherein the contact comprises a hollow pillar-shaped contact being connected to a first lead being crimped at a first crimping portion by crimping, and; wherein the contact insertion opening comprises a first opening for inserting the hollow pillar-shaped contact.

Here, the first lead may be a lead connected only to the hollow pillar-shaped contact, a terminal, or a line (a conducting wire is included) connected to the hollow pillar-shaped contact. Therefore, if there is a contact on the opposite side from the first lead, the first lead may include a lead not connected to the contact on the opposite side. The first crimping portion may be used to distinguish it from a second crimping portion described below. The first crimping portion is connected to the hollow pillar-shaped contact. The hollow pillar-shaped contact may have a shape a hollow cylinder, which may be formed by rolling a thin plate member into a cylinder with a press or other tools, for instance. In such case, it is more preferable to have an opening in the base portion or the bottom of the hollow pillar-shaped contact. with the opening, the contact may emit or release more heat. The base portion is located around a bottom end of a pillar-shaped portion and closer to the first crimping portion. A tip portion on the other end from the base portion is closed unlike the bottom end. The closed tip portion may improve the state of engagement with the plug to be connected to, and the appearances from outside the housing. The pillar-shaped portion of the hollow pillar-shaped contact may have a column shape, a square pillar-shape, a curved cylinder-shape and so on, but it is not limited to. The shape of the pillar-shaped portion is adjusted for mating with the shape of the other party. The contact insertion opening may include a first opening to insert the hollow pillar-shaped contact therethrough, and the contact insertion opening usually has a size equal to or larger than the first opening. A variety of part members, which have functions described below, can be disposed in the first opening.

(7) The jack according to (6), wherein the hollow pillar-shaped contact comprises an L-shaped tongue piece in a vicinity of a base portion toward the first crimping portion of the hollow pillar-shaped contact; wherein the contact insertion room includes a first insertion room for inserting the hollow pillar-shaped contact; wherein the hollow pillar-shaped contact is to be inserted through the first opening into the first insertion room; and; wherein the first insertion room comprises: a pillar insertion opening for inserting the hollow pillar-shaped contact along the pillar axis, a first stopping portion for controlling rotation around the pillar axis of the hollow pillar-shaped contact by engaging with the L-shaped tongue piece, in a vicinity of the pillar insertion opening, and a second stopping portion for stopping the hollow pillar-shaped contact at a predetermined position by butting the L-shaped tongue piece as the hollow pillar-shaped contact proceeds into the pillar insertion opening.

Here, the L-shaped tongue piece may include a tongue piece arranged in the vicinity of the base portion of the hollow pillar-shaped contact, and extending substantially orthogonal to the pillar axis. The first insertion room has a shape allowing to insert the hollow pillar-shaped contact and, usually, has a shape to insert in the direction of the pillar axis, but not being limited to this, may include a case to insert in the direction substantially orthogonal to the direction of the pillar axis. The first insertion room, if the contact is inserted in the direction of the pillar axis, may have a first opening having a shape matched to the section shape of the pillar. The pillar insertion opening similarly has a shape matched to the section shape of the pillar, and moreover, it is preferable that the clearance is comparatively small, and thereby, backlash of the hollow pillar-shaped contact becomes small. The L-shaped tongue piece may have a function as a lance so that the hollow pillar-shaped contact may be inserted along the slit for the guide of the L-shaped tongue piece, the slit being installed in the vicinity of the pillar insertion opening. The first stopping portion, which controls the rotation around the pillar axis of the hollow pillar-shaped contact, may include the wall of the slit for guiding, and can be called lance. The housing may include a second stopping portion that stops the insertion progress of the hollow pillar-shaped contact when it is inserted from the first opening, the pillar portion thereof is inserted through the pillar insertion opening, and the hollow pillar-shaped contact is arranged at a predetermined position in the housing. The second stopping portion that butts the L-shaped tongue piece and stops the progress of the hollow pillar-shaped contact can be formed as a step in the slit for guiding. That is, the edge part of the bottom of the tongue piece of the hollow pillar-shaped contact of which degree of freedom in the rotation direction is limited by the slit abutting to such step, for instance, and thereby the insertion (progress) of the hollow pillar-shaped contact can be stopped.

(8) The jack according to (6) or (7), wherein the hollow pillar-shaped contact has a pillar connection base portion and an engagement base portion in a vicinity of the base portion toward the first crimping portion of the hollow pillar-shaped contact, and wherein the first contact insertion room of the housing includes a third stopping portion for preventing the hollow pillar-shaped contact from falling off the housing by stopping the engagement base portion.

Here, the pillar connection base portion may mean the portion on the base side of a cylindrical portion of hollow pillar-shape in the hollow pillar-shaped contact, and the portion continuously extending from the member in the aforementioned cylindrical portion. The portion may be disposed in a position between the aforementioned two L-shaped tongue pieces. Further, the engagement base portion is an edge or side of the base side of the cylindrical portion of hollow pillar-shape in the aforementioned hollow pillar-shaped contact, and is arranged on a facing side of the pillar connection base portion in a bottom view in which the cylindrical portion is looked up from the bottom. The engagement base portion may engage with the third stopping portion of the housing and may limit the movement opposing to the insertion direction of the hollow pillar-shaped contact such that it may prevent the hollow pillar-shaped contact from falling, and that it can prevent the hollow pillar-shaped contact being pushed further when the contact engages with the plug. The aforementioned third stopping portion is a protrusion possessed by the housing. Although the third stopping portion is retracted by the outside wall of the cylinder portion while the hollow pillar-shaped contact being inserted. Due to the elastic nature thereof, the third stopping portion may turn back as a step to the insertion route of the contact so as to engage with the engagement base portion when the insertion of the hollow pillar-shaped contact is once completed so that the engagement base portion once passes through the aforementioned third stopping portion. These engagement base portion or third stopping portion might be called lance.

(9) The jack according to (5) or (6), wherein the contact comprises a J-shaped contact having a J-shaped cross section that includes an elastically-bendable front contact connected to a second lead being crimped at a second crimping portion, and the contact insertion opening includes a second opening to insert the J-shaped contact, may be provided. Here, the contact having a J-shape cross section which comprises an elastically-bendable front contact may include a contact to secure the contact pressure by elasticity. Moreover, it may include the one where the section shape at the substantial center makes a J-shape. The second opening is an opening that opens to insert the contact, and as for the character, it is substantially same as the first opening.

(10) The jack according to (9), wherein the J-shaped contact comprises: a rectangular back plate, a cross section of which constitutes a main part of the J-shaped cross section; a lower bending portion being arranged between the rectangular back plate and the elastically-bendable front contact and providing the elastically-bendable front contact with a spring back force; and right and left guide plates extending frontward from right and left sides of the J-shaped cross section with L-corners; wherein the contact insertion room includes a second insertion room for inserting the J-shaped contact, wherein the J-shaped contact is inserted into the second insertion room through the second opening, and wherein the second insertion room includes right and left slit openings guiding the right and left guide plates so as to direct the J-shaped contact into the second insertion room.

Here, the rectangular back plate may mean a rectangular back plate of which main longitudinal section, which is a longitudinal bar shape at the right of a shape in the J-shape that is the lengthwise section shape of the J-shaped contact, appears rectangular, when viewed from the back. The bending part or the hook part in the J character at the bottom of the J-shaped contact is arranged in the middle of the way from the rectangular back plate to an elastically-bendable front contact on the front side, and may secure spring back force for the elastically-bendable front contact. It is plausible that each guide plate extending in L form from both sides of the rectangular back is a state where the back extending from both sides of the rectangular back is bent substantially at the right angle. However, to secure the bend of the bending part, a cut might become necessary in the bending part. Therefore, these right and left guide plates may extend in a so-called front side direction of the J-shaped contact. The condition similar to the case of the hollow pillar-shaped contact applies to the second insertion room for inserting the J-shaped contact and the second opening. The movement of the guide plate can be limited to one direction (slide direction of the cover) so that the slit opening may insert the aforementioned right and left guide plates, so as to insert the J-shaped contact into the housing smoothly.

(11) The jack according to (10), wherein the J-shaped contact comprises: tip edges positioned at lower ends of the right and left guide plates; and a wedge projection protruding with a wedge slope along a insertion direction into the housing and being arranged on the rectangular back plate being composed of a substantially flat rectangular plate member; wherein the second contact insertion room comprises: a fourth stopping portion for stopping the J-shaped contact to be inserted into the second insertion room by having the tip edges butt the fourth stopping portion, the fourth stopping portion being disposed on an inner wall of the second insertion room; and a fifth stopping portion being composed of a fragment piece extending from the inner wall of the second insertion room and being to engage with the wedge projection.

Here, the tip edge in the lower end of the right and left guide plates is a tip of the aforementioned right and left guide plates in the direction of insertion of J-shaped contact, and may include the edges of boards such as edges, ends and sides. The rectangular back plate, that has the aforementioned right and left guide plates on both side, is composed of a substantially flat (plane) rectangular board. If the place where there is the tip edge is expressed as the lower side, the wedge projection that protrudes in the wedge shape in respect to the insertion direction of the aforementioned housing placed on the rectangular back plate may include the uplift of wedge shape where the protrusion gradually grows from the lower part to the upper part of the rectangular back plate. Moreover, it may include an orthogonal triangle wedge projection that returns to the rectangular back plate at once when the maximum uplift area in the wedge projection is exceeded. At this time, it may include the case where a gap or space exists like the burr or return of an arrowhead between the maximum uplift and the rectangular back plate. The fourth stopping portion is a part of the second insertion room inner wall, and may include a region or member that stops the J-shaped contact and its progress in the insertion direction by abutting on the tip edge. The tip edge projects to the traveling direction of insertion, and the fourth stopping portion abutting on the same may include projecting shape, flat shape, or, even recessed shape (concaved type) regardless of the form, provided that it engages with the tip edge. The fifth stopping portion, that is composed of a piece extending from the inner wall of the aforementioned second insertion room is a spatula-like piece and, if the insertion traveling direction is expressed as downward, may include the one that extends from the inner wall of the J-shaped contact, gradually approaching the rectangular back plate while facing below, and it can be called lance. At this time, because the tip portion of the piece engages with the wedge projection, it is desirable that engagement parts of the both have a shape that suits the purpose. These fifth stopping portion and wedge projection can be called lance.

(12) The jack according to (5), wherein the contact comprises: a hollow pillar-shaped contact connected to a first lead being crimped at a first crimping portion; and a J-shaped contact having a J-shaped cross section that includes an elastically-bendable front contact connected to a second lead being crimped at a second crimping portion; wherein the contact insertion opening comprises: a first opening for inserting the hollow pillar-shaped contact therethrough; and a second opening for inserting the J-shaped contact therethrough, and; wherein the housing comprises a crimp isolation wall extending toward the contact insertion opening so as to separate the first crimping portion and the second crimping portion, the crimp isolation wall being disposed between the first opening and the second opening.

Here, "first lead", "first crimping portion", "hollow pillar-shaped contact", "second lead", "second crimping portion", "J-shaped contact", "contact insertion opening", "first opening", and "second opening" are similar to those explained so far. The crimping isolation wall may include a wall arranged between the first opening and the second opening, and extends to isolate the first crimping portion and the second crimping portion. A wall that puts the first crimping portion and the second crimping portion into the state of electrical insulation is preferable, and it is desirable that the wall is composed of a non-electroconductive material, though neither shape nor the form of the crimping isolation wall are especially limited. Because the contact insertion opening includes the first opening and the second opening, the crimping isolation wall may be included in the contact insertion opening. In this case, the crimping isolation wall may become a wall by which at least a part of the first opening and the second opening is partitioned.

(13) The jack according to any one of (5) to (12), wherein the contact insertion opening is substantially rectangular, wherein the housing has a plurality of sides defining the contact insertion opening, and wherein at least two opposing sides among the plurality of sides have a guide member for having the cover slide with a side end of the cover engaging the guide member to close the contact insertion opening.

Here, though an opening shape that can take any shape, excluding two opposing substantially straight sides of the opening, a substantially orthogonal quadrilateral like the square, rectangle and so on is more preferable from the viewpoint of the standard. That the housing has a plurality of sides defining the contact insertion opening may mean that the contact insertion opening is located within the outline thereof in the plan view of the housing. The plan view of the housing may, as mentioned above, more preferably, be a substantially orthogonal quadrilateral like the square, rectangle and so on. At least two opposing sides may be in a substantially parallel relation, but other sides may be in other relations. The side edge of the cover may be a mere edge part, and also, it may be a member having a convex shape along the side edge. Or, it may include a member having a concave groove shape on the side edge along the side edge. In this case, the guide member may properly take a concave, convex or other shape and it is preferable to include a slide projection, and allows the cover to slide. Moreover, it is preferable to have a slide mechanism in which, not only the cover slides, but the guide material limits the degree of freedom of the cover in directions other than the slide direction so that the cover doesn't drop out from the housing. For instance, it is the one like the combination of a convex portion and a groove.

(14) An electronic device utilizing the jack according to any one the aforementioned (1) to (13) is provided. Here, the electronic device may include a personal computer, notebook computer, radio, cassette, other electronic device or electric device. Moreover, a lap top computer utilizing the jack according to any one of the aforementioned (1) to (13), is provided.

DETAILED DESCRIPTION OF THE PREFERRED EMBODIMENT

Figure 1:
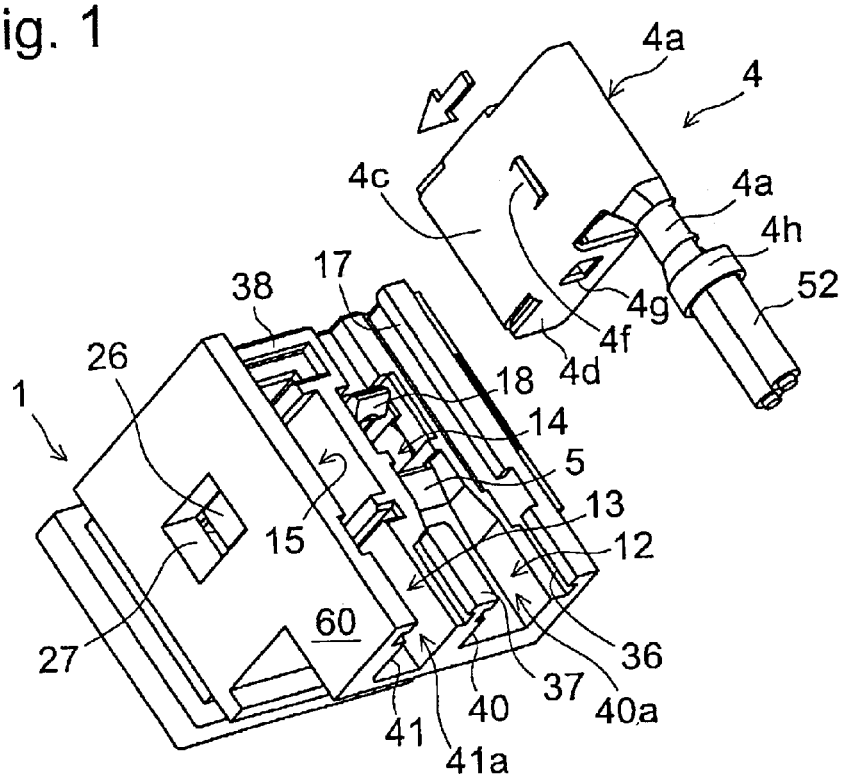
FIG. 1 is a perspective view showing an assembly procedure (insertion of contact) of a jack which is an example for executing the present invention.

Hereafter, embodiments according to the present invention will be described in detail referring to the drawings, but the present invention is not limited to the embodiments. The embodiments are examples showing concrete shapes and materials according to the present invention.

Figure 11:
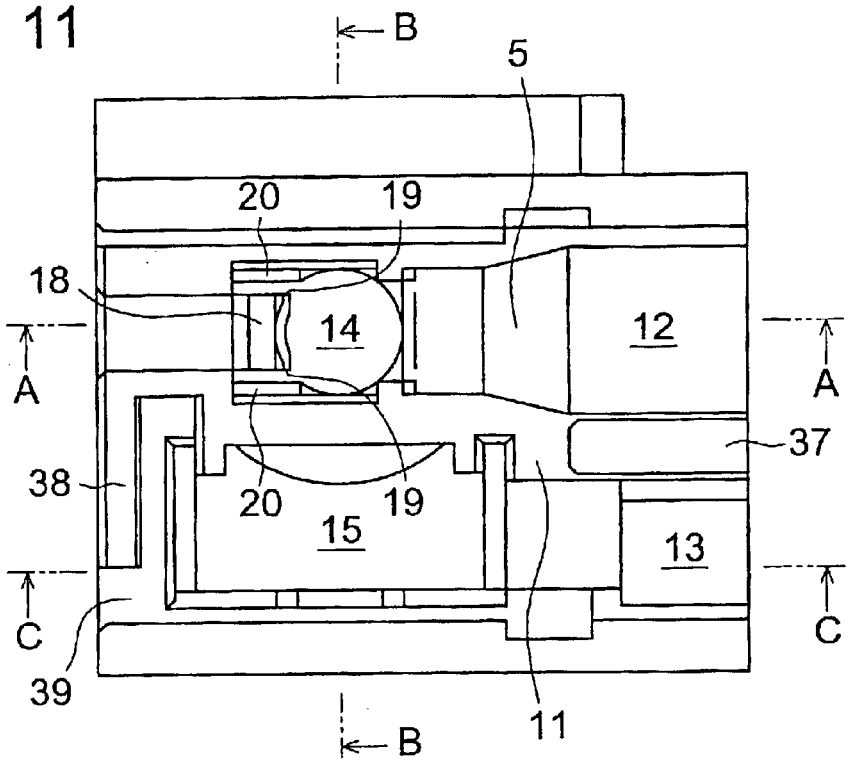
FIG. 11 is a plan view of FIG. 9.
Figure 13:
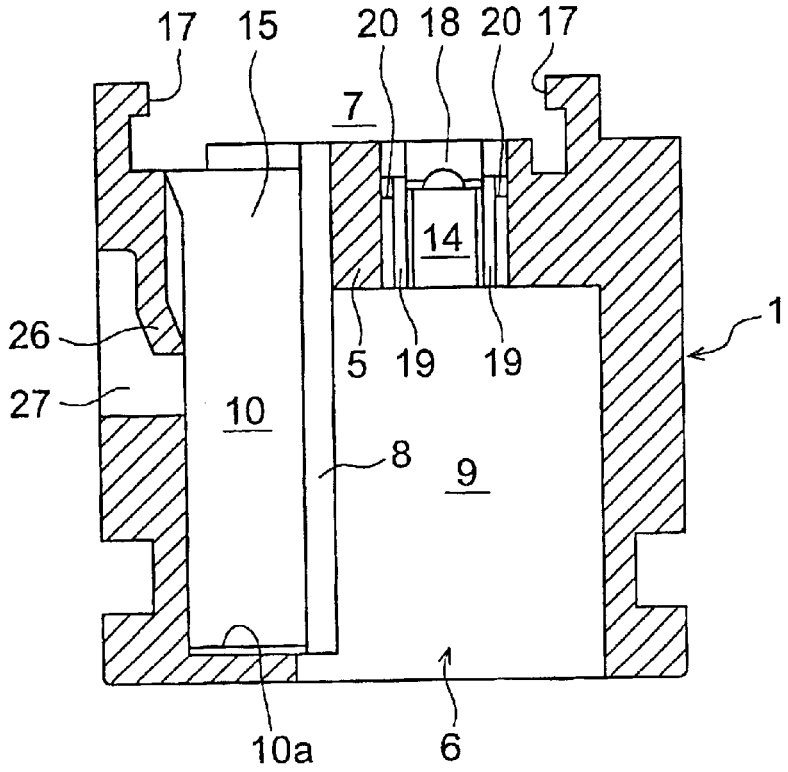
FIG. 13 is a B—B line cross-section of FIG. 11.

First of all, the structural function of the present embodiment will be described briefly, and afterwards, in detail with reference to each figure. The inside of housing 1 has a contact insertion opening 7 arranged on the upper side of a partition 5 as shown in FIG. 13. Housing 1 is partitioned by a partition 8 into two kinds of contact insertion room 9 and 10. Crimping storage parts 12 and 13 are partitioned by a partition 11 into two (Refer to FIG. 9). A first opening 14 and a second opening 15 of the contact insertion hole are formed in a partition 5, and they are made to lead to the first insertion room 9 and the second insertion room 10, respectively (Refer to FIG. 13). The first insertion room 9 and the second insertion room 10 are communicated through a contact opening 16 of the partition 8 (Refer to FIG. 14). On a back face 1*b* of the housing 1, a contact insertion opening 7 is formed in a way to face the whole. A lance 18 formed integrally with the partition 5 is disposed around the first opening 14 as shown in FIG. 11. A slit 19 is set on both sides of the lance 18, and a step part 20 is formed in the middle of the slit 19.

A hollow pillar-shaped contact 3 to be inserted into the first opening 14 is the one molded with the press working of a plate member and comprises a cylindrical contact main body 3*a*, a pair of L-shaped tongue pieces 3*b*, 3*b* provided in the vicinity of base portion of the contact main body 3*a*, and a first crimping portion 3*c* extending from the base portion of the contact main body 3*a* to connect with a lead 51. If the contact main body 3*a* of the hollow pillar-shaped contact 3 is inserted into the first opening aligning the directions of the L-shaped tongue pieces 3*b*, 3*b* and the slits 19, 19, the L-shaped tongue pieces 3*b*, 3*b* abut on the step parts 20, 20 and the contact main body 3*a* is inhibited to enter the contact storage part 9 and, at the same time, the lance 18 engages with the engagement base portion of the contact main body 3*a*, whereby the retreat of the contact main body 3*a* is obstructed, and the contact main body 3*a* is maintained at a prescribed position. As the L-shaped tongue pieces 3*b*, 3*b* are pinched between the slits 19, 19, the rotation of the contact main body 3*a* is also obstructed.

Figure 14:
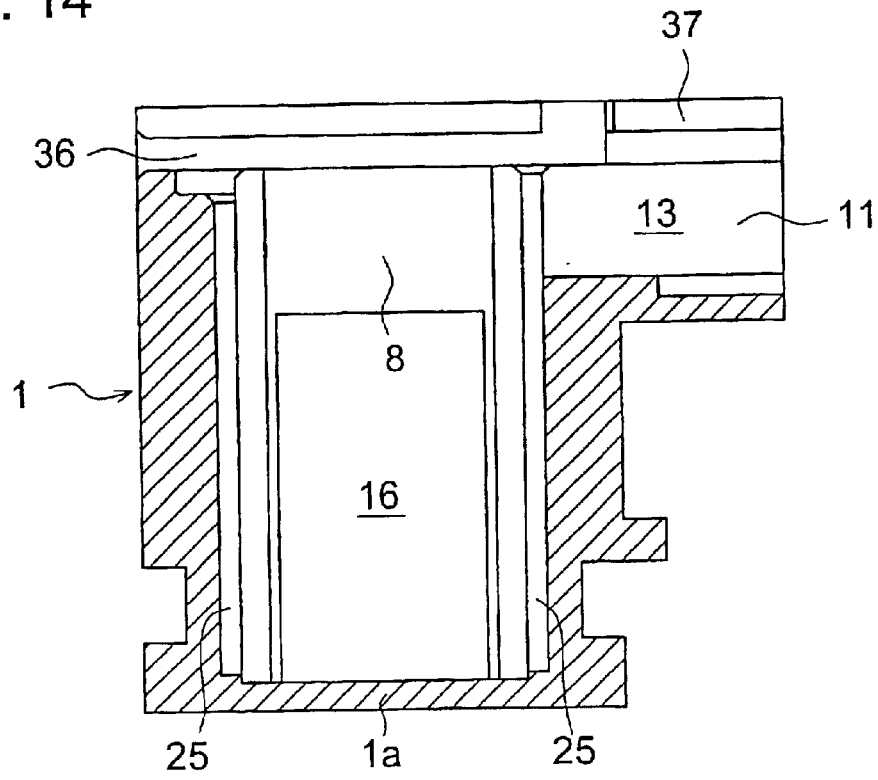
FIG. 14 is a C—C line cross section of FIG. 11.

The second opening 15 is formed rectangular in cross section, and guide grooves 25, 25 are formed in the face to back direction on the both corners of the partition 8 side (Refer to FIG. 14). A piece 26 (or, lance) is set at the point opposed to the opening 16 on the back of the second insertion room 10. The piece 26 is formed by extending a thin part of form in section from the periphery of a window 27 of the housing 1 as shown in FIG. 13.

Figure 10:
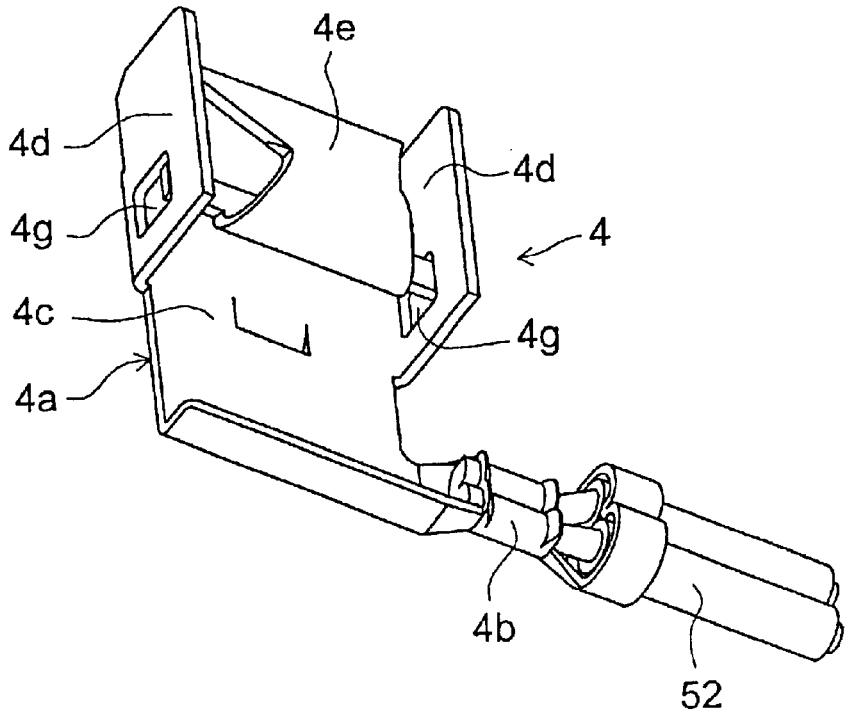
FIG. 10 is a perspective view showing a J-shaped contact

The J-shaped contact 4 is the one molded with the press working of a plate member, and composed of a contact main body 4*a*, and a crimping portion 4*b* for the connection with a lead 52 extending substantially at the right angle from a base edge of the contact main body 4*a* (Refer to FIG. 10). The contact main body 4*a* comprises a substantially rectangular back plate 4*c*, guide plates 4*d*, 4*d* bent and extended from both side edges thereof, an elastically-bendable front contact 4*e* that is bent at a bending part under the rectangular back plate 4*c*, and a wedge projection 4*f* (or, lance) installed in the center part of the rectangular back plate 4*c*. The variation stroke of the elastically-bendable front contact 4*e* according to insertion/extraction of the plug can be restricted by engaging both ends of the extension member at the tip of the elastically-bendable front contact 4*e* with the opening 4*g*, 4*g* of the guide plate 4*d*.

Bent fragments 4*d*, 4*d* are engaged with guide grooves 25, 25 and the contact main body 4 is inserted into the second opening 15, when the contact 4 is assembled to the housing 1 (Refer to FIG. 1). A further penetration of the contact main body 4*a* is obstructed when the tips (correspond to the tip edge) of both guide plates 4*d*, 4*d* bounds to the bottom inner wall of the second insertion room 10 and, at the same time, the lance 26 engages with a lance 4*f*, and the retreat of the contact main body 4*a* is obstructed. As a result, the contact main body 4*a* will be maintained at a prescribed position of the second insertion room 10. At this time, the elastically-bendable front contact 4*e* projects from the opening 16 of the partition 8 into the contact storage part 9 on the positive pole side.

Figure 9:
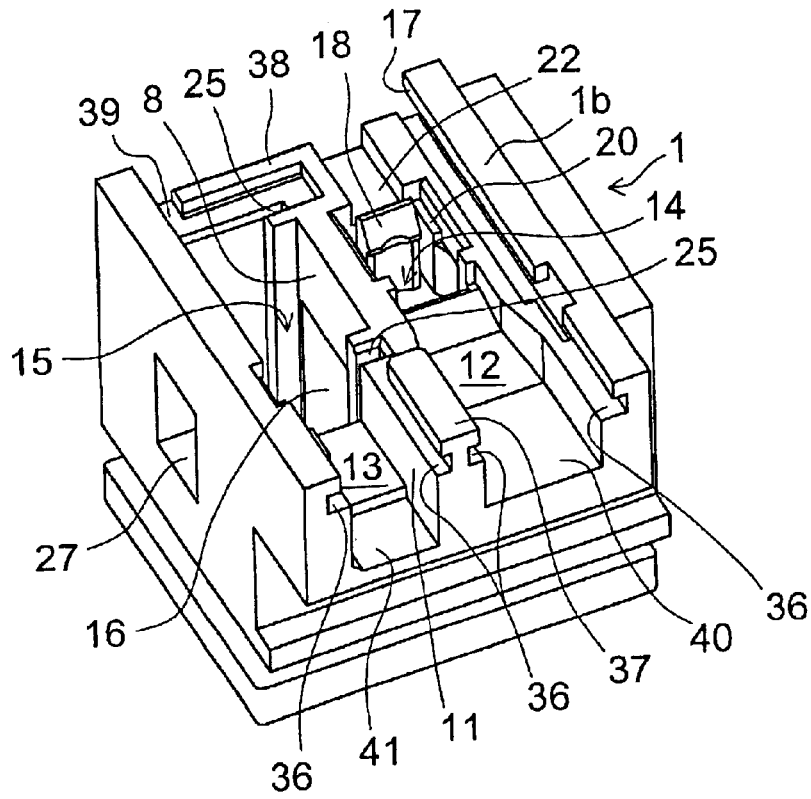
FIG. 9 is a perspective view showing a housing viewed from back side.

A pair of guide grooves 36 is formed in the housing 1 along the both side edges of the contact insertion opening 7 as shown in FIG. 9. In addition, a pair of guide grooves 36 is formed in a stopper 37 that projects on the top face of the partition 11. On the top face of the partition 5, an uplift 38 that leads to a partition 8 is formed, and a concave portion 39 is formed adjacent to the tip of the uplift 38. Moreover, lead extending parts 40, 41, that lead to the crimping storage parts 12, 13 are formed.

Figure 5:
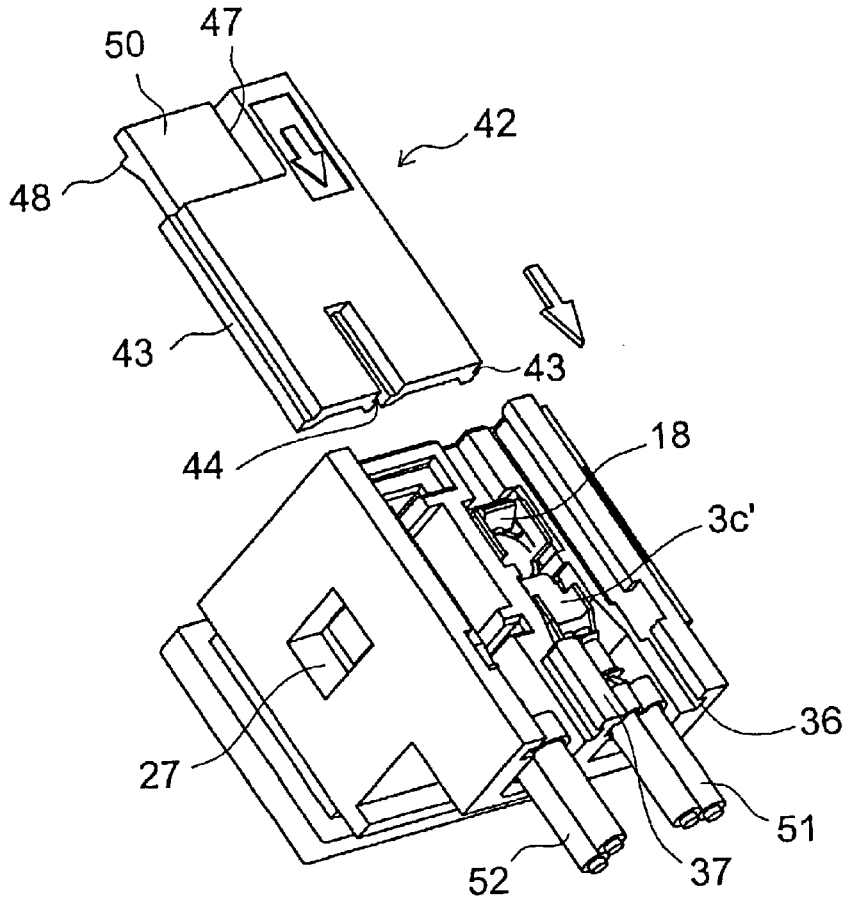
FIG. 5 is a perspective view which showing an assembly procedure (engagement of cover) of the jack which is an example for executing the present invention.

The contact insertion opening 7 of the housing 1 is closed by a cover 42 where a slide projection 43 is formed respectively on both side edges thereof (Refer to FIG. 5). The slide projection 43 is also formed on the opposite face of the slit 44 installed on the front edge of the cover 1. Concave portions 45, 46 for the interference evasion are formed on the back side of the cover 42 at the position corresponding to the lead extending part communicating with each crimping storage part on both sides of the slit 44. In addition, a slit 47 is formed at the rear end of cover 1, and a wedge-shaped uplift part 48 and an uplift 49 are set on the back side of the cover 42 on both sides of the slit 47.

When the cover 42 is to be fitted in the housing 1, the slide projection 43 is engaged with the guide groove 36, and the cover 42 is made to slide in the direction of the arrow in the drawing (Refer to FIG. 5). When the front edge of cover 42 reaches the stopper 37, a slide projection 43 in the slit 44 engages with the guide groove 36 of the stopper 37. Afterwards, the slope of the wedge-shaped uplift 48 runs aground on the uplift 38, a vertical face 48*b* of the wedge-shaped uplift engages with the uplift 38, the slit 44 bounds to the stopper 37, and the cover 42 will be prevented from sliding by the stopper 37 and the uplift 38.

Next, the method of assembling the power supply jack will be described.

Figure 2:
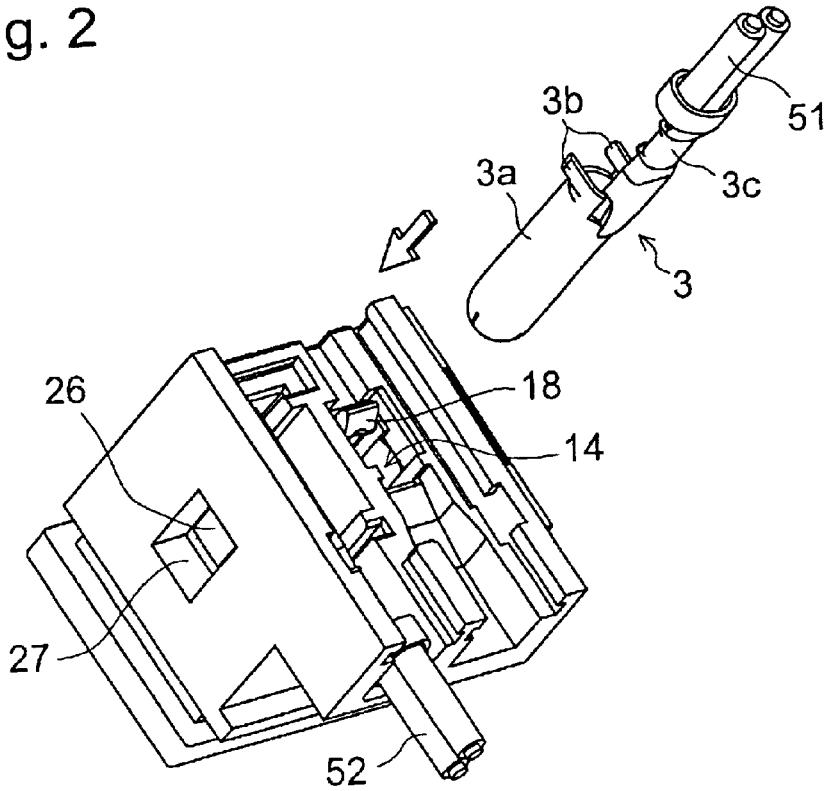
FIG. 2 is a perspective view showing an assembly procedure (insertion of another contact) of the jack which is an example for executing the present invention.
Figure 3:
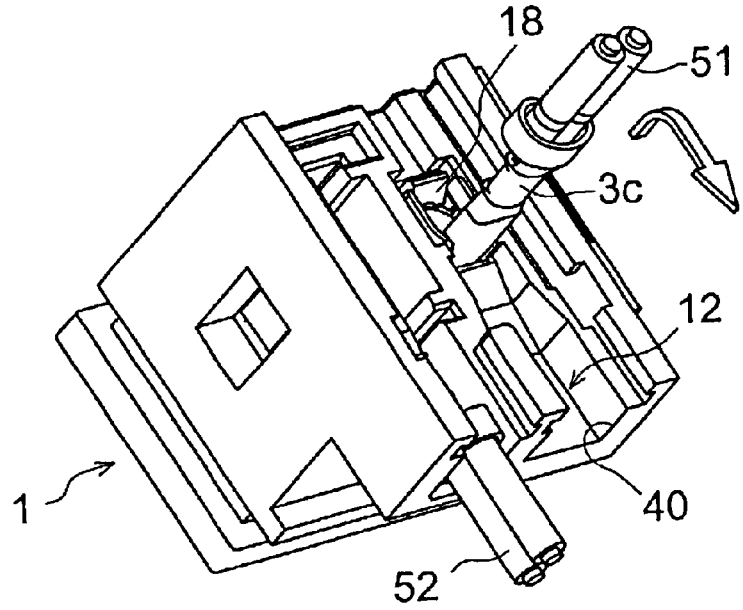
FIG. 3 is a perspective view showing an assembly procedure of the jack which is an example for executing the present invention (bending processing in the vicinity of the contact base portion).

Beforehand, the crimping portions 3*c*, 4*b* of two kinds of contacts 3, 4 are caulked and connected with leads 51, 52. First of all, the crimping 4*b* is stored in the crimping storage part 13 by inserting and fixing the contact main body 4*a* of the J-shaped contact into the contact insertion room 10 through the second opening 15 as shown in FIG. 1, and the lead 52 is taken out of the housing 1 from the lead extending part 41. Next, the lead 51 is taken out of the housing 1 from lead extending part 40 by bending as shown in FIG. 3 for storing the crimping portion 3*c* in the crimping storage part 12, after the pillar-shaped contact main body 3*a* is maintained in the first insertion room 9 through the pillar insertion opening 14 as shown in FIG. 2. Finally, the cover 42 is fitted into the contact insertion opening 7 of the housing 1 as shown in FIG. 5.

Now, the present embodiment will be described in detail by explaining each drawing hereafter. FIG. 1 shows how a contact 4 of J-shape in section ("J-shaped contact") having an elastically-bendable front contact is inserted into an opening ("contact insertion opening") arranged on the back face 1*b* of the housing 1 of the jack of the present embodiment. The housing 1 has a shape like a rectangular box as a whole which is enclosed with a back face 1*b* shown at the top right in the drawing, four side faces adjacent to four sides of the back face, and surface 1*a* that can be seen downward in FIG. 7 but cannot be seen left downward in FIG. 1. A window 27 is installed approximately at the center part on the first side that can be seen forward in FIG. 1, among four side faces, and a thinned piece 26 (or, lance) is arranged therein. A rectangular uplift 60 projecting from the second side on the back face 1*b* side of the housing 1 is formed on the second side downward in the figure and next to the first side, and two substantially rectangular openings are disposed on the second side face side of the uplift 60. These openings are lead extending openings 40*a*, 41*a*, and lead extending parts 40, 41 that lead to each opening are installed in the uplift. These lead extending parts 40, 41 are open in the direction of the back face of the housing 1 and the aforementioned uplift, viewed from the aforementioned second side face side, has a W letter shape or a sidewise E letter shape. A guide groove 36 that slides a cover 42 described below is formed into a concave shape in three open tip parts of E character of the E letterform member. The guide groove 36 is an example of executing the aforementioned guide member, and is formed on the back face 1*b* of the housing 1 substantially in parallel. A projection part 17 on the upper side of the guide groove 36 forms one wall defining the guide groove 36, and has a function to maintain the cover 42 described below so that the cover 42 should not part from the housing when the cover 42 slides along the guide groove 36. A central tip part 37 among three open tip parts of the aforementioned E character functions as a stopper when the cover 42 described below slides to obstruct an opening on the back face 1*b* of the housing 1. The stopper 37 is formed on the aforementioned two lead extending parts 40, 41 and the partition 11 isolating each crimping portion storage passage that runs to these extension parts.

Figure 12:
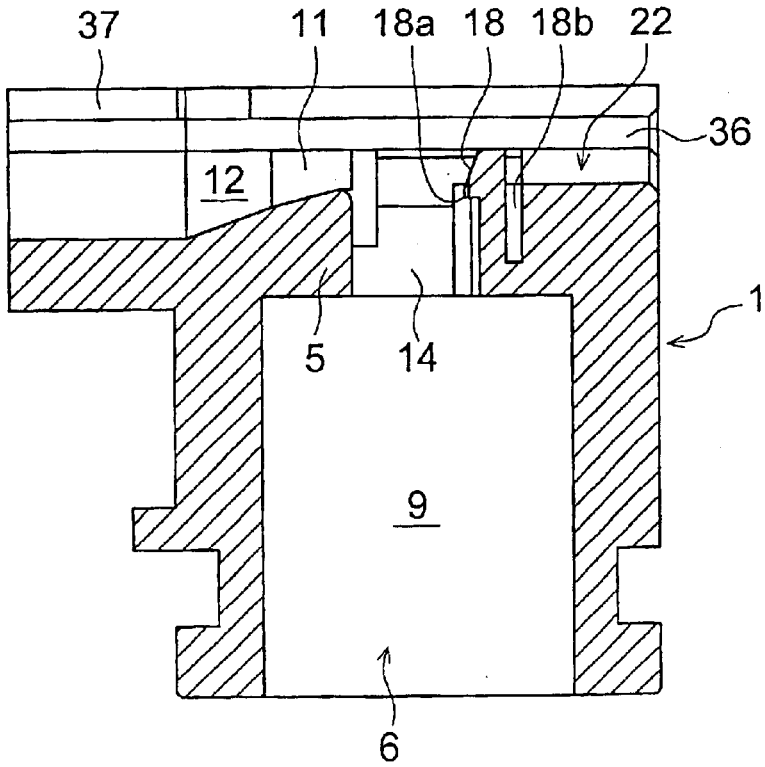
FIG. 12 is an A—A line cross-section of FIG. 11.

In FIG. 1, a travel through the lead extending opening 40*a* and the lead extending part 40 passes through a concaved part for housing the crimping portion of the hollow pillar-shaped contact that is the first crimping portion, that is, the crimping storage part (or, first crimping portion storage passage) 12 when going up, and then leads to a space (or, member extension part) for housing a member extending from the base portion of the hollow pillar-shaped contact to the hollow pillar-shaped contact and, further, to the first opening 14 for inserting the hollow pillar-shaped contact (Refer to FIG. 12). The depth of the first crimping portion storage passage 12 and the member extension part becomes shallow according to the protrusion of the back face 1*b* side of the partition 5 defining the bottom thereof. On the first opening 14, a so-called lance 18 that is an example of executing the third stopping portion is arranged at the position opposed to the member extension part, in the surroundings of the pillar insertion opening 14*a*. The lance 18 is a member whose longitudinal section shape standing with the housing back face 1*b* side up in the figure is the shape of or reverse and the cross-section area is rectangular. A slit 19 is installed on both sides of the lance 18, and the lance 18 is movable back and forth using the elasticity of a member where the lance 18 is connected continuously to the housing 1 in the lower part thereof. A slit 18*b* is installed in the back of the lance 18 to adjust force necessary for the movement, and the cross-section area and so on of the continuously connected members are adjusted. When lance 18 is pushed back (back side) by the width, the slit 18*b* can give such degree of freedom that moves the lance 18.

Therefore, it is possible to make the lock mechanism with the lance function without causing excessive resistance, when the pillar-shaped contact is inserted in the pillar insertion opening 14*a*. Moreover, in the vicinity of the tip of the nose of the shape of the lance 18, there is a part scooped out a little like the circular arc to match it to the pillar insertion opening 14*a*, so that the cylindrical hollow pillar-shaped contact 3 can be inserted smoothly.

The lead extending openings 40*a*, 41*a* comprise a lock mechanism in which an uplift 38 is formed in the vicinity of the housing side on the other side of them and engaged with a wedge-shaped uplift 48 of the cover 42 described below. The second opening 15 included in the contact insertion opening is open so that the J-shaped contact 4 whose section shape looks like J character can be inserted into the second insertion room 10. The J-shaped contact 4 is composed of main body contact 4*a*, second crimping portion 4*b*, and crimping portion 4*h* for holding the lead 52 connected by the second crimping portion 4*b*. The main body contact 4*a* includes, though explained more in detail below, a rectangular back plate 4*c* thereof and a guide plate 4*d* (an opening 4*g* is included) arranged on both sides of the same. In the rectangular back plate 4*c*, there is a member 4*f* (or, lance) that protrudes in wedge form that is an example of executing the wedge projection member, substantially at the center thereof, and it is capable of engaging with the aforementioned piece 26.

FIG. 2 shows how the hollow pillar-shaped contact 3 is inserted into the inside of the housing from the first opening 14 of the contact insertion entrance, in the housing of the jack of the present embodiment, after the J-shaped contact 4 is inserted into the second insertion room 10 of housing 1 and fixed to a predetermined position. The hollow pillar-shaped contact 3 is composed of a cylindrical main body 3*a*, L-shaped tongue pieces 3*b* and a first crimping portion for crimping the lead. The respective members are aligned in a straight line along the pillar axis, in hollow pillar-shaped contact 3 before insertion, as shown in the figure. Although the tip of the hollow pillar-shaped contact 3 (to the insertion direction of the arrow) faces left bottom in the figure, it is possible to close it by a method similar to the one for making the hollow cylindrical main body 3*a* from a sheet metal. The tip is made spherical in the present embodiment for jack standard, appearances, and other reasons. As it can be understood from the drawing, the hollow pillar-shaped contact 3 is inserted in the pillar insertion opening 14*a* through the first opening 14 with the tongue piece 3*b* thereof directed upward and left in the figure, so that it is set in the slit 19 on both sides of the lance 18.

FIG. 3 shows the state where the hollow pillar-shaped contact 3 is inserted into the pillar insertion opening 14*a* through the first opening 14 and fixed to the predetermined position. The edge (It is an edge on an interior angle side of L in a horizontal stick of L when comparing it to a downward L letterform) on a tip side in the pillar axis of the tongue piece 3*b* abuts on the step difference 20 made in the slit 19 to obstruct further insertion progress of the tongue piece 3*b*. As a result, the insertion progress of the hollow pillar-shaped contact 3 is stopped. Here, the step difference 20 is a flat part which is formed in the slit 19, and provided outside of the cylindrical main body 3*a* of the slit 19 (refer to the FIG. 11 and FIG. 13). In addition, a nose tip part 18*a* of the lance 18 that has been pushed outward by the cylindrical main body 3*a* at this time. Having exceeded the engagement base portion situated at the base end part of the cylindrical main body 3*a*, it returns inside the pillar insertion opening 14*a* by the spring back force, engages with the engagement base portion, and the hollow pillar-shaped contact 3 is prevented from being detached. The clearance to the hollow cylindrical main body 3*a* of the pillar insertion opening 14*a* is not so large, though the stopping portion 18*a* (It may be included in the third stopping portion) that is the nose tip part of the lance 18 connects in one place with the engagement base portion so that it is not easy to incline the cylindrical main body 3*a* from the pillar axis and cancel the engagement. That is, the pillar insertion opening 14*a* limits the movement of the cylindrical main body 3*a* to the bottom right in the figure.

Figure 4:
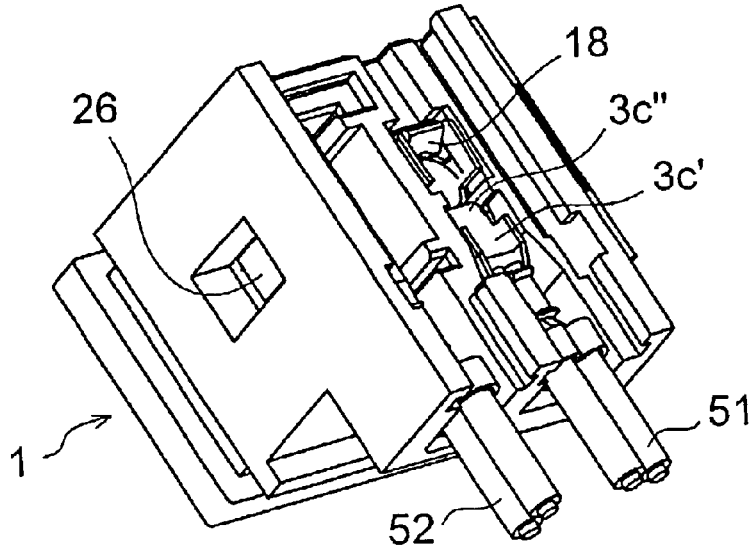
FIG. 4 is a perspective view showing an assembly procedure (storage of crimping portion) of the jack which is an example for executing the present invention.

The hollow pillar-shaped contact 3 fixed at the predetermined position of the first insertion room 9 of the housing 1 is bent in the direction of the arrow (direction of closing slide of the cover 42) in the figure, and it accommodates the first crimping 3*c* in the crimping portion storage passage 12 and the lead 51 into the lead extending part 40 from the crimping side to the lead extending opening 40*a*. FIG. 4 shows the state where the hollow pillar-shaped contact 3 is thus bent and stored in the concave portion of the housing. The part, that corresponds to the pillar connection base portion of the hollow pillar-shaped contact 3, is a part located between the first crimping 3*c* and the base portion of the cylindrical main body 3*a*. More specifically, it corresponds to an extension part with rib 3*c*' and a bent part without rib 3*c*" in the FIG. 4. The extension part with rib 3*c*' has a larger resistance to the bend to such an extent as that there is a rib, and is stored in the crimping portion storage passage 12 substantially in a straight state. On the other hand, it is easy to bend the bent part without rib 3*c*" because there is no rib, and being located in the vicinity of a corner part (Refer to FIG. 12) of the partition 5. Therefore, it can be prevented from being not able to be stored in the concave portion of the housing 1 for the bend part to extend more than the necessity, and to curve greatly. The corner part of the partition 5 makes an acute angle, taking spring back in the bending into consideration.

FIG. 5 shows how the opening 7 on the back face 1*b* is closed by sliding the cover 42, after the J-shaped contact 4 and the hollow pillar-shaped contact 3 are inserted in the housing 1, and the crimping portions 4*b*, 3*c*, and so on of each contact are stored in the concave portion on the back side of the housing 1 respectively. The cover 42 is a board-like one having a substantially rectangular form, and provided with a slit 44 substantially in parallel with the sliding direction by a prescribed length, on the tip side, to the slide direction shown by the arrow in the figure. A slide projection 43 same as the one being on both sides of the cover 42 is installed at both ends defining the slit 44. The slide projection 43 is fitted into the guide groove 36 of the housing 1 and can make the cover 42 slide along the guide groove 36. The cover 42, having a slit 47 in the rear thereof, and a thinned wall part 50 can deform independently of the area where an arrow is imparted to the surface of the right side thereof. A wedge-shaped uplift part 48 is formed on the back face of the thinned wall part 50, composing the lock mechanism of the cover 42 together with the uplift 38 of the housing.

Figure 6:
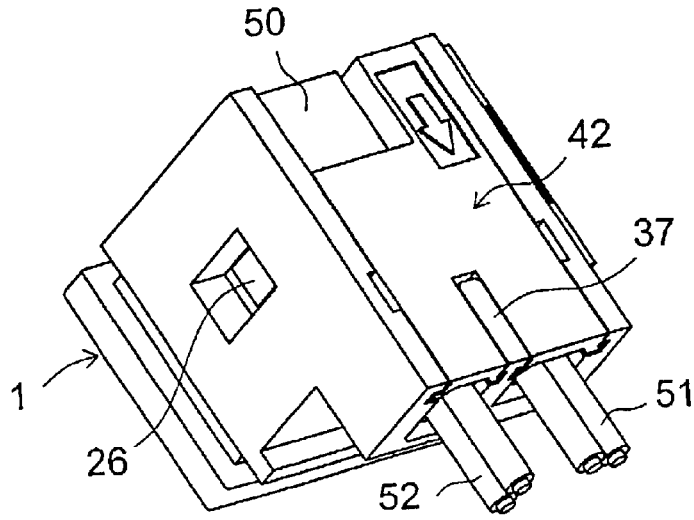
FIG. 6 is a perspective view showing an assembly procedure (assembly completion) of the jack which is an example for executing the present invention.

First of all, the slide projection 43 on both sides of the tip part of the cover 42 is engaged with the guide groove 36 on the periphery of the both sides of the housing 1. At this time, a protrusion 17 forming the guide groove 36 is placed on the top side (or on the back face side) of the slide projection 43, restricting the movement of the cover 42 to the top side, so that the cover 42 will not leave to come off the guide groove 36 and separate from the housing 1 even in case when the cover 42 slides to close the contact insertion opening 7. After the tip of the cover 42 is engaged with the slide projection 43 thereof in the guide groove 36, the cover 42 is pushed straight in the slide direction of the arrow as much as possible. When the tip of the cover 42 reaches the end part for the slide direction of the stopper 37 of the housing, the slide projection 43 in the slit 44 of the cover 42 starts to engage with the guide groove 36 that exists in the stopper 37, and the relation between both becomes similar to the relation between the slide projection part 43 and the guide groove 36 on both sides. However, since the protrusion 17 forming the guide groove 36 that exists in the stopper 37 comes to be located in the vicinity of the lead extending oparts, the separation of the cover 42 in the upward direction becomes hard. In FIG. 6, when the leads 51, 52 are pulled up in the figure, force to pull up the cover 42 acts at the lead extending openings 40*a*, 41*a*. Therefore, such reinforcement structure by the guide groove 36 or the like in the stopper 37 is very desirable. Returning to FIG. 5, the uplift 38 of the housing begins to come in contact with a slope 48*a* in the wedge-shaped uplift 48 when the slide of the cover 42 advances a little more. There is no drastic change, and the slide can be done until the contact insertion opening 7 is closed, though a little resistance increase is seen for the slide of the cover 42 because the slope 48*a* in the wedge-shaped uplift 48 has a shape where the protrusion gently increases toward the tail from the tip. Resistance at this time can be adjusted for the optimal resistance by adjusting the thickness and the length of the thinned wall part 50. When the cover 42 is closed, the wedge-shaped uplift 48 gets over the uplift 38 of the housing 1, engages with the concave portion in front by the spring back force of the thinned wall part 50. As a result, the cover 42 is made difficult to slide backwards and open the opening part. This is because the edge part 48*b* of the wedge-shaped uplift part 48 and uplift part 38 are mutually in contact with their sheer face. Here, the stopper 37 abuts on the endmost part of the slit 44, so that the progress of the cover 42 in the slide direction will be stopped. That is, the cover 42 is stopped its movement and its position comes to be fixed by being pinched between the stopper 37 and the uplift 38 and, moreover, between the projection part 17 and the groove part 36.

Figure 7:
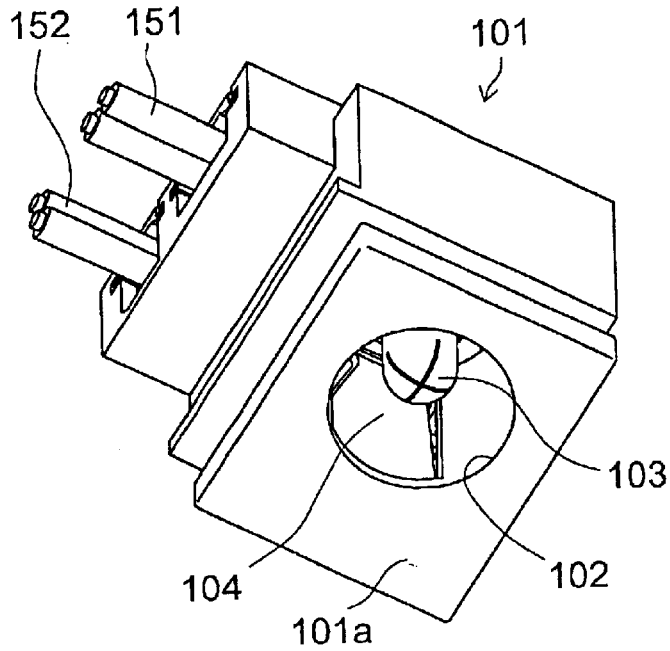
FIG. 7 is a perspective view showing the power supply jack of FIG. 6 viewed from face

FIG. 6 shows the state where the contact insertion opening 7 is closed as mentioned above. Thus the completed jack has a very compact shape. The groove installed to round on the side beside the surface side of the housing 1 can be used for attaching to the frame and the body of the device for which the jack is used. Therefore, the jack can be fixed without adding mechanical force to electric connection parts of the jack. FIG. 7 shows the completed jack which is looked up from under. A round opening 2 that opened substantially at the center of a surface 1*a* of the housing 1 is a hole to insert an outside terminal such as plugs to be connected to the jack. The tip part of the hollow pillar-shaped contact 3 is seen from the opening 2. Moreover, an elastically-bendable front contact of the J-shaped contact 4 is seen from the opening 2. These two contacts can be used respectively in a relation like the positive and the negative or the positive and the earth, and so on. In this case, assembly and disassembly are always possible for the jack of the present embodiment, and it will only have to release each lock mechanism when disassembling and to make respective part do a movement opposite to the aforementioned.

Figure 8:
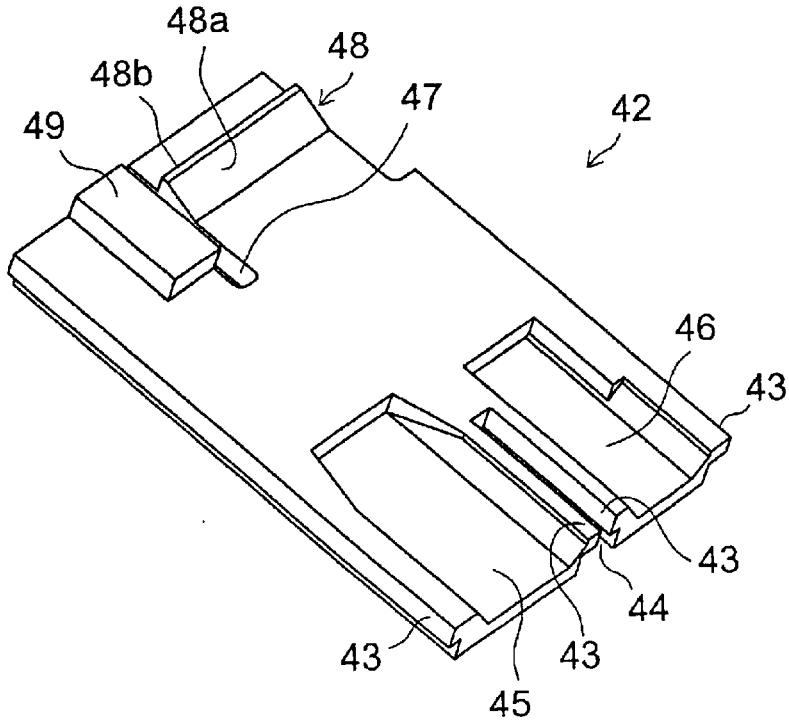
FIG. 8 is a perspective view showing the cover of FIG. 5 viewed from back side.

FIG. 8 shows the back side of the cover 42 in detail. In the tip of the cover 42, there is a slit 44, and a slide projection 43 is formed at the edge of the cover 42 that defines a slit 44 similarly to the projection 43 at the side edge of the cover 42. A concave portion 46 of the right side in the drawing corresponds to the lid part of the crimping storage part where the second crimping portion 4*b* of the J-shaped contact and crimped leads are stored and the lead extending part when the housing 1 is closed by the cover 42. Moreover, a left side concave portion 45 corresponds to the lid part of the crimping storage part where the second crimping portion 3*c* of the hollow pillar-shaped contact 3 and crimped leads are housed and the lead extending part. Thus, these concave portions 46, 45 can make the aforementioned storage space larger. On the back side of the cover 42, there is a slit 47, and an uplift 48 composing a part of the lock mechanism of the cover 42 on the right, a gentle slope 48*a* thereof, and an edge 48*b* like a steeply sheer wall. An uplift 49 is arranged on the left of slit 47, and approaches the back of lance 18 abutting on or up to an immediate proximity, and restricts the mobility of the lance 18 in the direction in which the hollow pillar-shaped contact comes off.

FIG. 9 shows each member of the housing 1 in detail. The guide groove 36 is installed under the projection part 17 in the upper part of the both side walls of the housing 1, and also installed in the upper part of the stopper 37 at the center of the this side face, composing the closing mechanism of the slide type contact insertion opening 7 in combination with a slide projection 43 on the both side edge faces and so on of the cover 42 mentioned above. There is a crimping storage part 13 for storing the crimping portion of the J-shaped contact of the lead 52 to be connected by crimping on this side of the second opening 15 for inserting the J-shaped contact of the contact insertion opening 7 and, furthermore, a lead extending part 41 before the same, and a lead connected to the J-shaped contact by crimping extends from the lead extending opening 41*a* (FIG. 1) which is the left side opening in the sectional drawing of the W shape or pushed-down E shape, in case of viewing to this side face of an uplift 60 (FIG. 1) existing on this side face. The opening on the right is the lead extending opening 40*a* for extending the lead 51 connected to the hollow pillar-shaped contact 3 by crimping that leads to the lead communication part 40 in the interior thereof, and to the first crimping storage part 12 further in the depth. The partition 11 to separate the first crimping portion and the second crimping portion has a stopper 37 thereon. Because the partition 11 has the upper surface of the stopper 37 in a flush relation with the upper surface of the cover 42, the partition 11 having no opening therein can surely isolate both contacts electrically. The procedure for inserting the J-shaped contact 4 will be described referring to FIGS. 1 and 9, while explaining the structure of the J-shaped contact 4 referring to FIG. 10. The J-shaped contact 4 is composed of the contact main body 4*a* and the crimping 4*b* connected with the lead 52 by crimping as mentioned above. In the contact main body 4*a*, a rectangular back plate 4*c*, guide plates 4*d*, 4*d* bent forward substantially at the right-angle on both sides thereof and an elastically-bendable front contact 4*e* that can have a contact pressure secured by the elasticity force caused in the lower bending portion at the bottom of a J character are arranged in a place on the front side of the rectangular back plate 4*c* and enclosed with the guide plates 4*d*, 4*d* on both sides. The elastically-bendable front contact 4*e* has further a tip tucked member extending in the breadth direction that is constricted on both sides by the openings 4*g*, 4*g* of the guide plates 4*d*, 4*d* in a tucked-in tip portion. As the movement of the tip tucked member extending in the breadth direction is limited by the openings 4*g*, 4*g*, the movable elasticity contact 4*e* is limited to the size or less of the openings 4*g*, 4*g* in the magnitude of the elasticity deformation and so on. An incision is made on both sides of the tip side (or, lower side) of the rectangular back plate 4*c* in FIG. 1, so that the connection side length of the guide plates 4*d*, 4*d*, and the rectangular back plate 4*c* on both sides has narrowed a little. The purpose of this is to adjust properly the elasticity force by said lower bending portion, and a portion (a tip edge, though slightly rounded, substantially orthogonal to rectangular back plate 4*c*) on the foremost tip of the both guide plates 4*d*, 4*d* projects lower than the lower bending portion or at the tip. Therefore, the tip edge comes into contact with the flat bottom 10*a* ("lower flat face") earlier than the lower bending portion, when the J-shaped contact 4 is advanced in the insertion direction thereof, because the bottom shape of the second insertion room 10 is flat (Refer to FIG. 13). Such a lower flat face may be included in one example of executing the fourth stopping portion. Therefore, an external stress never works especially by the insertion on the lower bending portion, so that the influence hardly reaches the elasticity characteristic secured in the movable contact 4*e*.

The J-shaped contact 4 arranges the rectangular back plate 4*c* on the this side with the wedge projection part 4*f* as shown in FIG. 1 and both guide plates 4*d*, 4*d* on both sides are inserted in the guide grooves 25, 25 (FIG. 9) on the second opening 15 of the housing 1 in a way to fit them in. Therefore, the piece 26 runs aground on the protrusion slope in wedge projection part 4*f* as the J-shaped contact 4 is inserted, the tip edges of the guide plates 4*d*, 4*d* on both sides abut on the lower flat face 10*a* in the second insertion room when the J-shaped contact 4 is inserted into the second insertion room completely, and the insertion progress of the J-shaped contact 4 is stopped. At this time, the piece 26, that has run aground on the protrusion slope in the wedge projection 4*f*, gets over the maximum uplift in the wedge projection 4*f*, the tip thereof is pushed inside the second insertion room 10 by the spring back force of the piece itself, and at the same time, the maximum uplift tip edge of the wedge projection 4*f* gets over the piece 26 and will be pushed back outside the second layer entering room 10 (or, direction of the back of the rectangular back plate) by its own spring back force. However, normally, as the contact is formed with metal, and the piece, that is a part of the housing, is made of synthetic resin, the elastic deformation in the wedge projection is sometimes little or almost absent, and in these cases, the metal hardly deforms and, exclusively, the piece 26 is pushed back internally by its own repulsion force. Thus, a tip edge of the piece 26 engages with the maximum protrusion edge of the wedge projection when the piece 26 is pushed back internally and the J-shaped contact 4 will be fixed in the second insertion room 10. The uplift 38 is a component of the lock mechanism of the cover 42 as mentioned above. The lance 18 engages with the engagement base portion of the hollow pillar-shaped contact 3 inserted as mentioned above at the nose tip part 18*a*, prevents the hollow pillar-shaped contact 3 from dropping and, at the same time, opposes to the pushing force, when a plug and so on (not shown in the figure) are connected to the jack. The nose tip part 18*a* can be included in one example of executing the aforementioned third stopping portion. The uplift 49 placed under the cover 42 comes to a concave portion 22 when the cover 42 is slid, and functions to oppose to the deformation towards the back of the lance 18. The step difference 20 abuts on the tip of the tongue piece 4*b* to stop the insertion progress of the hollow pillar-shaped contact 3. The projection part 17 forms a guide groove 36, and has a function of not to allow the cover 42 to detach from the housing 1, by suppressing the slide projection 43 thereof from the upper side.

FIG. 11 is a plan view of the housing 1 seen from the back face 1*b* thereof. As for each constituent object, it is same as having explained hereinabove. The A—A section is shown in FIG. 12, the B—B section in FIG. 13 and the C—C section in FIG. 14 to show the internal structure of the housing 1 more clearly. The circular arc seen on the tip of the second opening 15, in FIG. 11, is an edge 2 of an opening that opens on the surface 1*a* of the housing 1. FIG. 12 is the cross section where the first opening had been cut in the direction of the slide of cover 42 viewed toward the second opening 15 side. Though the first insertion room 9 communicates with the second insertion room 10 in the rectangular opening part, a pillar insertion opening 14, that has a comparatively narrow clearance to the cylindrical main body 3*a* of the hollow pillar-shaped contact 3 is located thereon. The lance 18 possesses a nose tip part 18*a* limiting the upward movement of the cylindrical contact main body 3*a* by engagement, and adjusts the deformation resistance in the direction to the back thereof by a slit 18*b* in the back. FIG. 13 is the cross section where a section vertical to the slide direction of the cover 42 is seen from the tip part to the tail side for the slide direction, through the center of the pillar insertion opening 14. The contact insertion opening 7 is located in a space between both side projection parts 17. The position of the step difference 20 abutting on the tongue piece 4*b* can clearly be understood in height. The first insertion room 9 and the second Insertion room 10 communicate each other with a space without partition 8 (contact opening 16 (FIG. 9)), and the movable contact 4*e* of the J-shaped contact 4 will appear in the first insertion room at the communicating opening, in a jack into which the contact is inserted entirely. As a result, the other pole of the plug where the cylindrical contact main body 3*a* is inserted comes in contact with the movable contact 4*e*, and electric energy and so on can be transmitted. A hemicycle is drawn in the nose tip part 18*a* of the lance 18, because of showing that the cylindrical contact main body 3*a* was made easier to insert, by scraping off the portion a little. FIG. 14 is the cross section where the second insertion room had been cut in the slide direction of the cover 42 which is viewed toward the first insertion room 9 side. The contact opening 16 opens to a space without partition 8 as mentioned above, and carries out the function as a jack.

Figure 15:
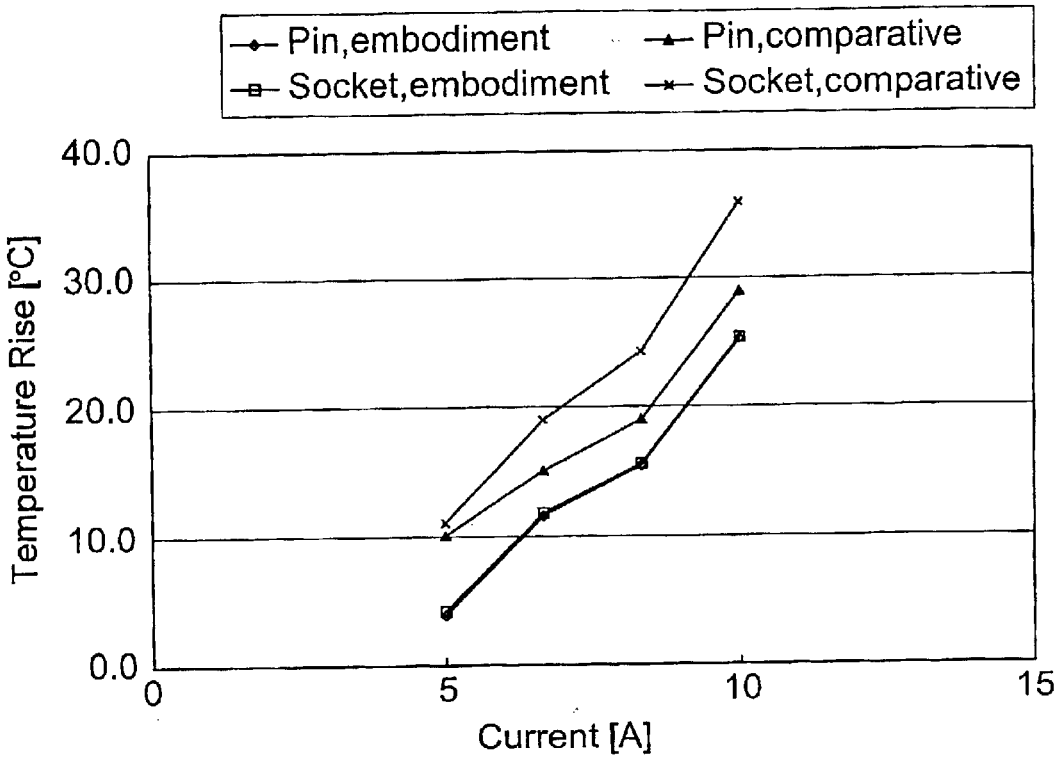
FIG. 15 is a graph showing the relation between the amount of current and the rise in temperature of a hollow pillar-shaped contact is shown.

FIG. 15 represents the heat releasing characteristic results of the hollow pillar-shaped contact 3 used in the present embodiment. In the figure, the vertical axis shows the temperature to have risen from an initial temperature (that is, temperature difference). The horizontal axis indicates the current value thrown into such a pillar-shaped contact. It is shown that the temperature elevation is large if going up in the figure, while the thrown current is large if going to the right. In the experiment, the temperature elevation is measured under the same condition by similarly throwing the current into a hollow pin of the present embodiment and a solid pin of the comparison example. Though the temperature measurement regions were the pin and the socket respectively, the measurement was performed in regions as equivalent as possible considering the specific shapes of the respective contacts. Open diamond shapes and square plots in the graph are the measurement results in the pin and the socket of present embodiment respectively. Moreover, the plot of a black triangle is the measurement result in the pin of the comparison example. X plot is the measurement result of the socket of the comparison example. It is understood that the rises in the temperature of the pin and the socket of the present embodiment are obviously lower compared with those values of the comparison examples from the graph, in all the current values. Thus, when the hollow pillar-shaped contact is used for the jack, it is understood that the rise in heat is controlled to low. It is plausible that this was caused because the heat emitting area grows as the contact is hollow and heat radiation is improved.

Figure 16:
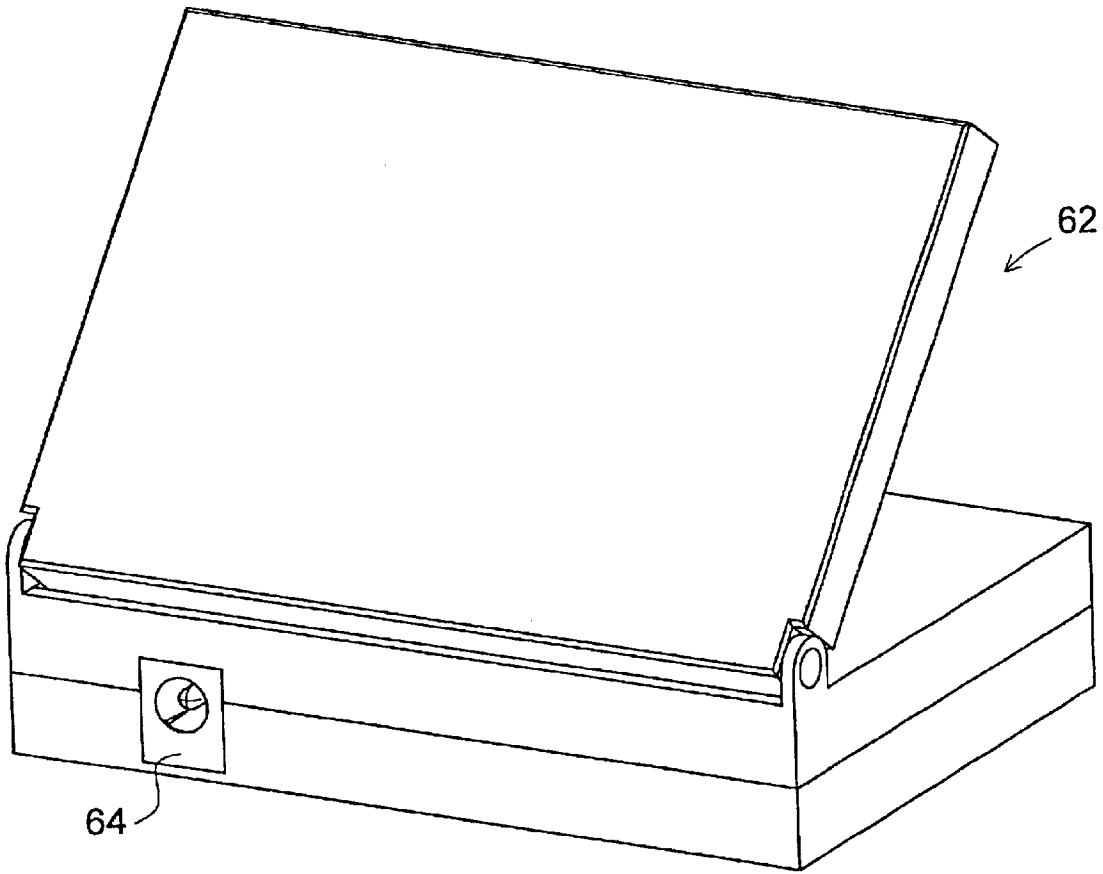
FIG. 16 is a perspective view showing an electric device that applies the jack which is an example for executing the present invention one.

FIG. 16 shows an example of applying the jack 64 which is one embodiment of the present invention to a notebook computer 62. The jack 64 is a power supply jack of the notebook computer 62. The cross, that is the feature pattern thereof, is seen in the tip of the hollow pillar-shaped contact from an opening for the plug connection. The jack of the present invention can be applied to not only such a notebook computer but also all electric equipment. Moreover, the scope of application thereof is not limited to the power supply, but can be applied to all of kinds of jack, which takes out, and receives an electric signal.

As described above, since, the jack according to the present invention is capable of preventing the decrease in the contact reliability because of no generation of the solder rack by the prying insertion as the connection between the contact and lead is executed by crimping and furthermore improving the heat radiation performance by adopting a hollow pin which is a crimping product as the positive pole compare to a solid pin. Moreover, the freedom degree of the design of DC jack arrangement can be raised because the substrate needs not be arranged up to the position of attachment, as it is not necessary to install it on the substrate, so that it becomes effective in making the machine thin. Moreover, because the connection with solder is not used, it assembles and disassembles easily at any time.

Although it has been explained about a jack provided with two contacts 3, 4 in the aforementioned embodiment, the present invention can also be applied to a power supply jack provided with a fixed contact piece in which the movable contact 4*e* of the contact 4 abuts thereon or departs therefrom, according to insertion/extraction of the plug.

What is claimed is:

1. A jack being connected to an electric energy supply or demand part through a lead, comprising:

a contact for contacting an outside terminal to be connected to the jack, the contact having a crimping portion for crimping the lead to be connected to the contact, a housing having a contact insertion opening through which the contact is to be inserted and a contact insertion room in which the contact is to be disposed and;

a cover for closing the contact insertion opening when the contact is disposed in the contact insertion room;

wherein the housing comprises:

a crimping portion storage passage for storing the crimping portion and a lead extending part for extending a lead from the crimping portion storage passage to outside of the housing, wherein the contact comprises a hollow pillar-shaped contact being connected to a first lead being crimped at a first crimping portion by crimping, wherein the contact insertion opening comprises a first opening for inserting the hollow pillar-shaped contact, wherein the hollow pillar-shaped contact comprises an L-shaped tongue piece in a vicinity of a base portion toward the first crimping portion of the hollow pillar-shaped contact, wherein the contact insertion room includes a first insertion room for inserting the hollow pillar-shaped contact, wherein the hollow pillar-shaped contact is to be inserted through the first opening into the first insertion room, and wherein the first insertion room comprises:

a pillar insertion opening for inserting the hollow pillar-shaped contact along the pillar axis, a first stopping portion for controlling rotation around the pillar axis of the hollow pillar-shaped contact by engaging with the L-shaped tongue piece, in a vicinity of the pillar insertion opening, and a second stopping portion for stopping the hollow pillar-shaped contact at a predetermined position by butting the L-shaped tongue piece as the hollow pillar-shaped contact proceeds into the pillar insertion opening.

2. The jack according to claim 1, wherein the hollow pillar-shaped contact has a pillar connection base portion and an engagement base portion in a vicinity of the base portion toward the first crimping portion of the hollow pillar shaped contact, and wherein the first contact insertion room of the housing includes a third stopping portion for preventing the hollow pillar-shaped contact from falling off the housing by stopping the engagement base portion.

3. The jack according to claim 1, wherein the contact insertion opening is substantially rectangular, wherein the housing has a plurality of sides defining the contact insertion opening, and wherein at least two opposing sides among the plurality of sides have a guide member for having the cover slide with a side end of the cover engaging the guide member to close the contact insertion opening.

4. An electronic device utilizing the jack according to claim 1.

5. The jack according to claim 1, wherein the contact comprises a J-shaped contact having a J-shaped cross section that includes an elastically-bendable front contact connected to a second lead the being crimped at a second crimping portion, and the contact insertion opening includes a second opening to insert the J-shaped contact.

6. The jack according to claim 5, wherein the contact insertion opening is substantially rectangular, wherein the housing has a plurality of sides defining the contact insertion opening, and wherein at least two opposing sides among the plurality of sides have a guide member for having the cover slide with a side end of the cover engaging the guide member to close the contact insertion opening.

7. The jack according to claim 5, wherein the J-shaped contact comprises:

a rectangular back plate, a cross section of which constitutes a main part of the J-shaped cross section, a lower bending portion being arranged between the rectangular back plate and the elastically-bendable front contact and providing the elastically-bendable front contact with a spring back force, and right and left guide plates extending frontward from right and left sides of the J-shaped cross section with L-corners;

wherein the contact insertion room includes a second insertion room for inserting the J-shaped contact, wherein the J-shaped contact is inserted into the second insertion room through the second opening, and;

wherein the second insertion room includes right and left slit openings guiding the right and left guide plates so as to direct the J-shaped contact into the second insertion room.

8. The jack according to claim 7, wherein the J-shaped contact comprises:

tip edges positioned at lower ends of the right and left guide plates, and a wedge projection protruding with a wedge slope along a insertion direction into the housing and being arranged on the rectangular back plate being composed of a substantially flat rectangular plate member;

wherein the second contact insertion room comprises:

a fourth stopping portion for stopping the J-shaped contact to be inserted into the second insertion room by having the tip edges butt the fourth stopping portion, the fourth stopping portion being disposed on an inner wall of the second insertion room, and;

a fifth stopping portion being composed of a fragment piece extending from the inner wall of the second insertion room and being to engage with the wedge projection.

9. The jack according to claim 1, wherein the contact comprises:

a hollow pillar-shaped contact connected to a first lead being crimped at a first crimping portion, and a J-shaped contact having a J-shaped cross section that includes an elastically-bendable front contact connected to a second lead being crimped at a second crimping portion;

wherein the contact insertion opening comprises:

a first opening for inserting the hollow pillar-shaped contact therethrough, and a second opening for inserting the J-shaped contact therethrough, and wherein the housing comprises a crimp isolation wall extending toward the contact insertion opening so as to separate the first crimping portion and the second crimping portion, the crimp isolation wall being disposed between the first opening and the second opening.

10. The jack according to claim 9, wherein the contact insertion opening is substantially rectangular, wherein the housing has a plurality of sides defining the contact insertion opening, and wherein at least two opposing sides among the plurality of sides have a guide member for having the cover slide with a side end of the cover engaging the guide member to close the contact insertion opening.

11. An electronic device utilizing the jack according to claim 9.

* * * * *